United States Patent [19]

Weaver

[11] Patent Number: 4,912,902

[45] Date of Patent: Apr. 3, 1990

[54] SIMULATED BRICK COVERING AND WALL CONSTRUCTION

[76] Inventor: Elvin W. Weaver, R.D. #3, Box 353, Ephrata, Pa. 17522

[21] Appl. No.: 885,504

[22] Filed: Jul. 14, 1986

[51] Int. Cl.[4] ..... B44F 7/00

[52] U.S. Cl. ..... 52/314; 52/384

[58] Field of Search ..... 52/314, 204, 746, 309.4, 52/389, 390, 554, 555, 315, 384, 386, 387, 388

[56] References Cited

U.S. PATENT DOCUMENTS

| | | | |
|---|---|---|---|
| 1,815,404 | 7/1931 | Greenebaum | 52/384 |
| 1,926,257 | 9/1933 | Bawtenheimer | 72/19 |
| 2,012,630 | 9/1935 | Joannides | 20/5 |
| 2,046,213 | 1/1936 | Schnorer | 72/18 |
| 2,114,451 | 11/1938 | Mattes | 72/23 |
| 2,933,919 | 5/1960 | Roeshoff | 72/28 |
| 2,938,376 | 10/1960 | Workman et al. | 72/19 |
| 3,426,490 | 12/1969 | Taylor | 52/204 |
| 3,496,694 | 3/1970 | Hicks et al. | 52/746 |
| 4,407,104 | 10/1983 | Francis | 52/309.4 |

FOREIGN PATENT DOCUMENTS

| | | | |
|---|---|---|---|
| 020655 | of 1905 | Austria | 52/314 |

*Primary Examiner*—Carl D. Friedman

*Attorney, Agent, or Firm*—Michael R. Swartz; John R. Flanagan

[57] ABSTRACT

A simulated brick wall in new or renovated construction utilizes the wallboard normally applied or already in place in such cases in combination with a plurality of birck-simulating boards and a material which simulates mortar. Each of the brick-simulating boards is elongated and has a pair of opposite front and rear surfaces, a pair of opposite end surfaces and a pair of laterally-spaced longtudinal opposite side surfaces extending between and interconnecting the front and rear surfaces and the opposite end surfaces. The side surfaces extend in opposite inclined relationship to the front and rear surfaces so as to provide the board in cross-section with a trapezoidal configuration wherein the front surface is wider than the rear surface. Each brick-simulating board has a plurality of spaced apart grooves defined in its front surface and extending between its side surfaces such that the front surface simulates the appearance of a row of spaced bricks. The brick-simulating boards are attached in side-by-side spaced apart relationship to the wallboard to simulate a brick wall in which respective side surfaces of adjacent ones of the spaced apart brick-simulating boards define gaps which simulate the spaces between rows of spaced bricks in the brick wall. The mortar-simulating material is disposed in the grooves in the front surfaces of the brick-simulating boards and in the gaps between the boards to simulate the appearance of mortar in the brick wall.

7 Claims, 1 Drawing Sheet

SIMULATED BRICK COVERING AND WALL CONSTRUCTION

BACKGROUND OF THE INVENTION

1. Field of the Invention

The present invention generally relates to building wall structures and, more particularly, is concerned with a wall covering adapted especially for remodeling a wall to simulate a brick wall.

2. Description of the Prior Art

Over the years, brick walls in buildings have had considerable appeal to the aesthetic tastes of a great many people. There have been many attempts to at least partially satisfy these tastes by the substitution of different constructions which try to simulate the brick wall appearance. Representative of the prior art are the constructions disclosed in U.S. Pat. Nos. to Bawtenheimer (1,926,257), Joannides (2,012,630), Schnurer (2,046,213), Mattes (2,114,451), Rueshoff (2,933,919), Workman et al (2,938,376), Taylor (3,426,490), Hicks et al (3,496,694) and Francis (4,407,104).

In both residential and commercial remodeling projects, a wall finish construction which substantially simulates the appearance of a brick wall should, at least in theory, have many advantages over an actual brick wall. One advantage should be that the simulated brick wall costs much less to install since the structure of the building may need to be reinforced to support an actual brick wall but not to support the simulated brick wall. Another advantage is that the simulated brick wall should have greater flexibility in where it can be placed due to the fact that no special substructural support is required. With equal capability, the components of the simulated brick wall should be mountable along the wall near the ceiling, the floor or anywhere inbetween. Yet another advantage is that the components of the simulated brick wall should be adapted to be applied efficiently on many different types of preexisting wall structures and be arranged together to cover wall areas of many different lengths and heights while concurrently recreating the genuine albeit irregular appearance of an actual brick wall. Still another advantage should be that the simulated brick wall occupy less room space than the brick wall. Yet another advantage should be that the simulated brick wall eliminate skin abrasions and clothing tears which normally will result from inadvertent human contact with an actual brick wall.

Many of the constructions of the prior art would appear to generally achieve their objectives under the limited range of conditions for which they were designed. Most of the constructions seem to fail to provide one or more of the aforementioned advantages which should be embodied by a wall construction which attempts to simulate an actual brick wall. Consequently, a need still exists for a renewed effort at providing an acceptable simulated brick wall construction.

SUMMARY OF THE INVENTION

The present invention provides wall covering and simulated brick wall construction designed to satisfy the aforementioned need. A hallmark of the simulated brick wall construction of the present invention is the simplicity, versatility and flexibility with which it provides all of the aforementioned advantages. While seemingly amounting to only a slight modification of the prior simulated brick wall construction in the above-cited Joannides patent, the construction of the present invention eliminates the shortcomings of the Joannides construction which made the latter less than an optimum substitute for an actual brick wall. In doing so, the present invention has made a substantial stride forward in terms of improved efficiency in the utilization of construction materials in providing the simulated appearance of an actual brick wall. Specifically, in renovation, the wall covering of the present invention uses less materials than in Joannides by making use of the existing wall board as the backing board in the simulated brick wall construction.

Accordingly, the present invention is directed to a wall covering for simulating a brick wall construction, comprising: (a) a plurality of boards; (b) each of the boards being elongated and having a pair of opposite front and rear surfaces and a pair of laterally-spaced longitudinal opposite side surfaces extending between and interconnecting the front and rear surfaces; (c) the longitudinal side surfaces extending in opposite inclined relationship to the front and rear surfaces so as to provide the board in cross-section with a configuration wherein the front surface is wider than the rear surface; (d) each of the boards having a plurality of grooves defined in its front surface in spaced apart relationship and extending between its side surfaces such that the front surface simulates the appearance of a row of spaced bricks, with each groove at its opposite ends opening at the inclined side surfaces of the board and having a bottom displaced between rear and front edges of the side surfaces at which the latter interconnect with the front and rear surfaces.

The present invention also provides a simulated brick wall construction, wherein the combination comprises: (a) a plurality of brick-simulating boards; (b) each of the boards being elongated and having a pair of opposite front and rear surfaces and a pair of laterally-spaced longitudinal opposite side surfaces extending between and interconnecting the front and rear surfaces; (c) the longitudinal side surfaces extending in opposite inclined relationship to the front and rear surfaces so as to provide the board in cross-section with a configuration wherein the front surface is wider than the rear surface; (d) each of the boards having a plurality of grooves defined in its front surface in spaced apart relationship and extending between its side surfaces such that the front surface simulates the appearance of a row of spaced bricks, with each groove at its opposite ends opening at the inclined side surfaces of the brick-simulating board and having a bottom displaced between rear and front edges of the side surfaces at which the latter interconnect with the front and rear surfaces; (e) at least one sheet of backing board applied to wall support members to provide a subwall prior to application of the brick-simulating boards to the backing board; (f) the brick-simulating boards being attached in side-by-side spaced apart relationship to the backing board to simulate a brick wall wherein respective front and rear surfaces of adjacent brick-simulating boards are disposed coplanarly in the generally parallel spaced apart planes and respective side surfaces of adjacent ones of the spaced apart brick-simulating boards define gaps which simulate the spaces between rows of spaced bricks in the brick wall, with each gap in cross-section having a configuration in which a back of the gap disposed coplanar with the rear surfaces of the brick-simulating boards is wider than a front of the gap disposed coplanar with the front surfaces of the brick-simulating boards, and (g) a material disposed in the grooves in the front surfaces of the brick-simulating boards and in the gaps between the brick-simulating boards to simulate the appearance of mortar in the brick wall.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
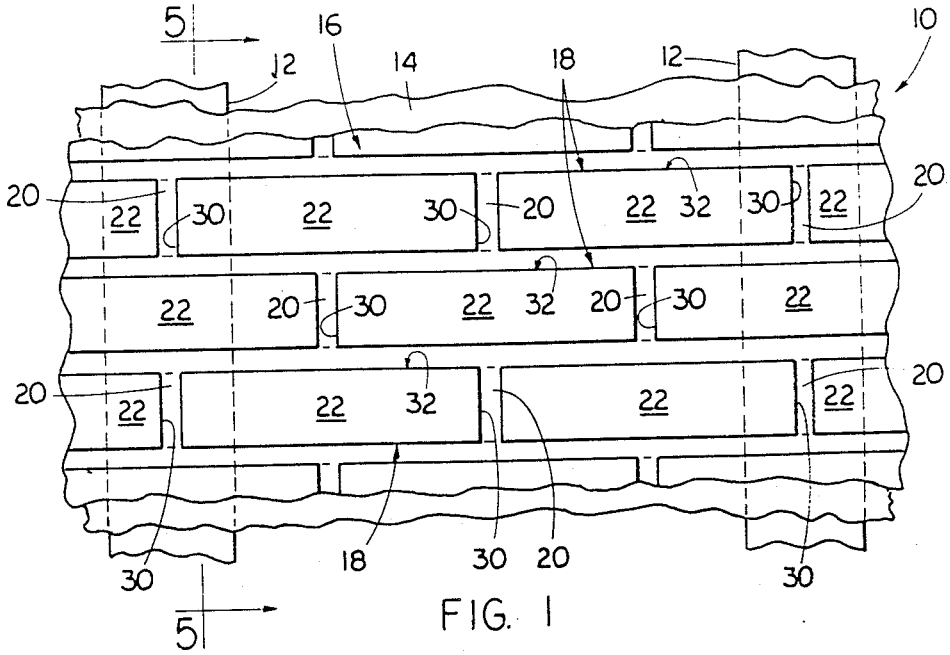
FIG. 1 is a fragmentary side elevational view of the simulated brick, wall construction of the present invention applied to spaced studs of a building.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring now to the drawings, and particularly to FIG. 1, there is shown the preferred embodiment of the simulated brick wall construction of the present invention, generally designated by the numeral 10, applied to spaced studs 12 of a building. The simulated brick wall 10 can be one built in either new or renovated construction. In both instances, it utilizes wallboard 14 which is normally applied or already in place in such types of construction.

Figure 5:
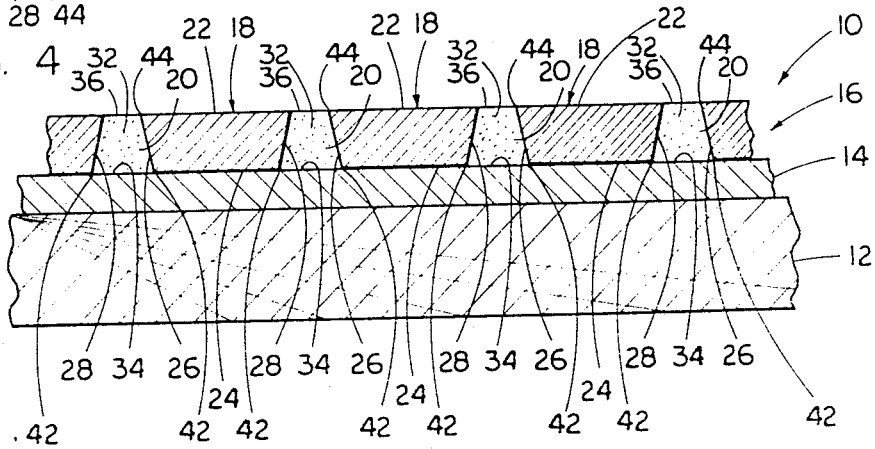
FIG. 5 is an enlarged fragmentary transverse sectional view of the simulated brick wall construction taken along line 5—5 of FIG. 1.

Referring also to FIG. 5 as well as FIG. 1, a wall covering, generally designated 16, comprised of a plurality of brick-simulating boards 18 and a suitable material 20 simulating mortar, which can be mortar itself or some synthetic caulking, is used in combination with the wallboard 14 to form the simulated brick wall 10. Each of the brick-simulating boards 18, preferably, although not necessarily, identical to one another, is elongated and has a pair of opposite front and rear surfaces 22,24, a pair of opposite end surfaces (not shown) and a pair of laterally-spaced longitudinal opposite side surfaces 26,28 extending between and interconnecting the front and rear surfaces and the opposite end surfaces. By way of example, the board 18 is composed of wood and can be twelve feet in length, two and one-half to three inches in width and approximately three-fourths inch in thickness.

Figure 2:
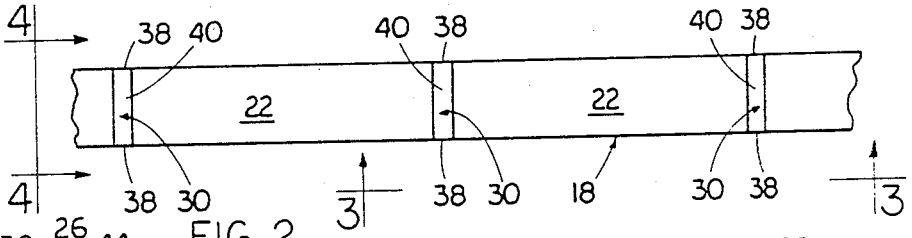
FIG. 2 is a fragmentary side elevational view of one of a plurality of substantially identical brick-simulating boards used in the simulated brick wall construction of FIG. 1.
Figure 3:
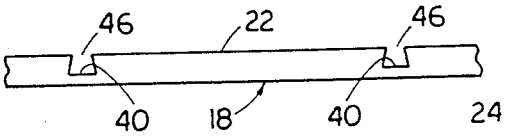
FIG. 3 is an enlarged fragmentary edge elevational view of the brick-simulating board as seen along line 3—3 of FIG. 2, showing in cross-section one of the longitudinally spaced-apart transverse grooves formed in the front surface or exposed face of the board.

The side surfaces 26,28 of each board 18 extend in opposite inclined relationship to its front and rear surfaces 22,24 so as to provide the board 18 in cross-section with, preferably, a generally dove-tail or trapezoidal configuration wherein the front surface 22 is wider than the rear surface 24. In addition, as seen in FIGS. 2 and 3, each board 18 has a plurality of grooves 30 defined in its front surface 22. Each groove 30, likewise preferably dove-tail or trapezoidal shaped in cross-section, extends between the side surfaces 26,28 of the board 18 and is longitudinally spaced apart from the next groove such that the front surface 22 of the board simulates the appearance of a row of spaced bricks.

The brick-simulating boards 18 are attached at their rear surfaces 24 vertically one above the other in side-by-side relationship to the wallboard 14 by any suitable means, such as by use of an adhesive or nails. In order to simulate a brick wall, the boards 18 are spaced apart vertically from one another sufficiently to define horizontal gaps 32 between their adjacent side surfaces 26,28 which simulate the spaces between the horizontal rows of spaced bricks in the brick wall 10. Given the cross-sectional configurations of the boards, as shown in FIG. 5, the gaps 32 are also dove-tail or trapezoidal shaped in cross-section. The mortarsimulating material 20 is applied in the grooves 30 in the front surfaces 22 of the brick-simulating boards 18 and in the gaps 32 between the boards 18 to simulate the appearance of mortar in the brick wall 10. The boards 18 can be painted or stained to the desired color either before or after being attached to the wallboard 14, but in either case before the mortar material 20 is applied to the grooves 30 and gaps 32.

Figure 4:
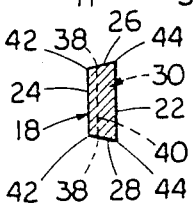
FIG. 4 is an enlarged transverse sectional view of the brick-simulating board taken along line 4—4 of FIG. 2, showing the reverse tapered or inclined configuration of the respective longitudinally-extending opposite side surfaces of the board.

More particularly, as seen in FIGS. 4 and 5, the front and rear surfaces 22,24 of the brick-simulating board 18 extend in generally parallel spaced apart planes. Furthermore, the longitudinal side surfaces 26,28 are disposed in planes which extend in opposite inclined relationship to, and intersect, the planes of the front and rear surfaces 22,24 so as to provide the board 18 in cross-section with the configuration of a trapezoid wherein the front and rear surfaces respectively form the top and base of the trapezoid with the top being wider than the base. As a result of this trapezoidal orientation, the trapezoidal configuration of the gaps 32 is reversed. That is, each gap 32 in cross-section has the configuration of a trapezoid with a back 34, which is contiguous to the wallboard 14 and disposed coplanar with the rear surfaces 24 of the boards 18 being wider than a front 36 of the gap, which is disposed coplanar with the front surfaces 22 of the boards 18.

Still further, each of the grooves 30 in the boards 18, which extends between the side surfaces 26,28 thereof, opens at its opposite ends 38 at the side surfaces of the board. The groove 30 also has a bottom 40 displaced between rear and front edges 42,44 of the side surfaces 26,28. The rear and front edges 42,44 on the board 18 are where its side surfaces 26,28 interconnect with its front and rear surfaces 22,24. Additionally, as shown in FIG. 3, the general trapezoidal configuration of each groove 30 is oriented such that the bottom 40 of the groove is disposed in spaced relationship between the front and rear surfaces 22,24 of the board 18 and is wider than a top or mouth 46 of the groove being disposed coplanar with the front surface 22 of the board.

Thus, in view of the cross-sectional configurations of the brick-simulating boards 18, when they are arranged in side-by-side spaced apart relationship and attached on the wallboard 14 to simulate a brick wall, the respective front and rear surfaces 22,24 of adjacent boards are disposed coplanarly in the generally parallel spaced apart planes. Additionally, the respective side surfaces 26,28 of adjacent ones of the spaced apart boards 18 define the aforementioned gaps 32 which simulate the spaces between the vertically-arranged rows of spaced bricks in the brick wall. Also, the respective trapezoidal configurations of the grooves 30 and gaps 32 enhance their ability to retain the mortar-simulating material 20 therein.

Finally, with the gaps 32 so formed by the act of placing and spacing the boards 18 in side-by-side relationship, it should be apparent that the boards are thereby adapted to be spaced apart at different distances so as to define the gaps with different widths. This allows the arrangement of the boards 18 to be adjusted on the wallboard 14 so as to cover wall areas of different dimensions without the necessity of trimming any of the boards longitudinally to complete the simulated brick wall with a row of bricks having less than full heights.

It is thought that the simulated brick covering and wall construction of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A wall covering for simulating a brick wall construction, comprising:

(a) a plurality of boards;

(b) each of said boards being elongated and having a pair of opposite front and rear surfaces and a pair of laterally-spaced longitudinal opposite side surfaces extending between and interconnecting said front and rear surfaces;

(c) said longitudinal side surfaces extending in opposite inclined relationship between and being connected to said front and rear surfaces so as to provide said board in cross-section with a configuration in which the width of said front surface between said longitudinal side surfaces is greater then the width of said rear surface;

(d) each of said boards having a plurality of grooves defined in its front surface in spaced apart relationship and extending between its side surfaces such that said front surface simulates the appearance of a row of spaced bricks, each groove at its opposite ends opening at said inclined side surfaces of said board and having a bottom displaced between rear and front edges of said side surfaces at which the latter interconnect with said front and rear surfaces;

(e) said boards of such configuration in cross-section thereby adapted to be arranged in side-by-side spaced apart relationship to simulate a brick wall in which respective side surfaces of adjacent ones of said spaced apart boards define gaps which simulate the spaces between rows of spaced bricks in the brick wall, said boards of such configuration in cross-section also thereby adapted to be spaced apart at different distances so as to define said gaps with different widths in order to cover wall areas of different dimensions without the necessity of trimming any of said boards longitudinally.

2. The wall covering as recited in claim 1, wherein:

said front and rear surfaces extend in generally parallel spaced apart planes; and said longitudinal side surfaces are disposed in planes which extend in opposite inclined relationship to, and intersect, said planes of said front and rear surfaces so as to provide said board in cross-section with the general configuration of a trapezoid in which said front and rear surfaces respectively form the top and base of the trapezoid with the top being wider than the base thereof.

3. The wall covering as recited in claim 1, wherein each said groove in cross-section has the general configuration of a trapezoid in which said bottom of said groove disposed in spaced relationship between said front and rear surfaces of said board is wider than a top of said groove disposed coplanar with said front surface of said board.

4. The wall covering as recited in claim 1, wherein each said gap in cross-section has a configuration in which a back thereof being disposed coplanar with said rear surfaces of said boards is wider than a front thereof being disposed coplanar with said front surfaces of said boards such that said boards are thereby adapted to receive and retain a material in said grooves in said front surfaces of said boards and in said gaps between said boards to simulate the appearance of mortar in the brick wall.

5. The wall covering as recited in claim 1, wherein said each gap in cross-section has the configuration of a trapezoid in which a back of said gap disposed coplanar with said rear surfaces of said boards is wider than a front of said gap disposed coplanar with said front surfaces of said boards.

6. A wall covering for simulating a brick wall construction, comprising:

(a) a plurality of boards;

(b) each of said boards being elongated and having a pair of opposite front and rear surfaces and a pair of laterally-spaced longitudinal opposite side surfaces extending between and interconnecting said front and rear surfaces;

(c) said front and rear surfaces extending in generally parallel spaced apart planes;

(d) said longitudinal side surfaces being disposed in planes which extend in opposite inclined relationship to, and intersect, said planes of said front and rear surfaces so as to provide said board in cross-section with the configuration of a trapezoid wherein said front and rear surfaces respectively form the top and base of the trapezoid with the top being wider than the base thereof;

(e) each of said boards having a plurality of grooves defined in its front surface in spaced apart relationship and extending between its side surfaces such that said front surface simulates the appearance of a row of spaced bricks, each groove at its opposite ends opening at said side surfaces of said board and having a bottom displaced between rear and front edges of said side surfaces at which the latter interconnect with said front and rear surfaces, each groove in cross-section having the general configuration of a trapezoid wherein said bottom of said groove disposed in spaced relationship between said rear and front edges of said side surfaces is wider than a top of said groove disposed coplanar with said front surface of said board;

(f) said boards of such configuration in cross-section thereby adapted to be arranged in side-by-side spaced apart relationship to simulate a brick wall wherein said respective front and rear surfaces of adjacent boards are disposed coplanarly in said generally parallel spaced apart planes and said respective side surfaces of adjacent ones of said spaced apart boards define gaps which simulate the spaces between rows of spaced bricks in the brick wall, each gap in cross-section having the configuration of a trapezoid wherein a back of said gap disposed coplanar with said rear surfaces of said boards is wider than a front of said gap disposed coplanar with said front surfaces of said boards, said boards of such configuration in cross-section thereby also adapted to be spaced apart at different distances so as to define said gaps with different widths in order to cover wall areas of different dimensions without the necessity of trimming any of said boards longitudinally, said boards of such configurations thereby further adapted to receive and retain a material in said grooves in said front surfaces of said boards and in said gaps between said boards to simulate the appearance of mortar in the brick wall.

7. In a simulated brick wall construction, the combination comprising:

(a) a plurality of brick-simulating boards;

(b) each of said boards being elongated and having a pair of opposite front and rear surfaces and a pair of laterally-spaced longitudinal opposite side surfaces extending between and interconnecting said front and rear surfaces;

(c) said longitudinal side surfaces extending in opposite inclined relationship between and connected to said front and rear surfaces so as to provide said board in cross-section with a configuration wherein said front surface is wider than said rear surface;

(d) each of said boards having a plurality of grooves defined in its front surface in spaced apart relationship and extending between its side surfaces such that said front surface simulates the appearance of a row of spaced bricks, each groove at its opposite ends opening at said inclined side surfaces of said board and having a bottom displaced between rear and front edges of said side surfaces at which the latter interconnect with said front and rear surfaces;

(e) at least one sheet of backing board adapted to be applied to wall support members to provide a sub-wall prior to application of said brick-simulating boards to said backing boards;

(f) said brick-simulating boards being attached in side-by-side spaced apart relationship to said backing board to simulate a brick wall wherein respective front and rear surfaces of adjacent brick-simulating boards are disposed coplanarly in said generally parallel spaced apart planes and respective side surfaces of adjacent ones of said spaced apart brick-simulating boards define gaps which simulate the spaced between rows of spaced bricks in the brick wall, each gap in cross-section having a configuration in which a back of said gap disposed coplanar with said rear surfaces of said brick-simulating boards is wider than a front of said gap disposed coplanar with said front surface of said brick-simulating boards; and (g) a material disposed in said grooves in said front surfaces of said brick-simulating boards and in said gaps between said brick-simulating boards to simulate the appearance of mortar in the brick wall;

(h) said brick-simulating boards being spaced apart on said backing board at different distances so as to define said gaps with different widths in order to cover wall areas of different dimensions without the necessity of trimming any of said brick-simulating boards longitudinally.

* * * * *